United States Patent [19]

Gentry

[11] Patent Number: 4,624,449

[45] Date of Patent: Nov. 25, 1986

[54] MECHANICAL PULLER

[76] Inventor: Samuel H. Gentry, 222 E. 8th St., National City, Calif. 92050

[21] Appl. No.: 779,607

[22] Filed: Sep. 23, 1985

Related U.S. Application Data

[63] Continuation of Ser. No. 622,753, Jun. 20, 1984, abandoned.

[51] Int. Cl.[4] ..... B21F 9/00

[52] U.S. Cl. ..... 254/231; 29/259

[58] Field of Search ..... 254/199, 231, 20; 29/256, 258, 259, 260, 261, 262

[56] References Cited

U.S. PATENT DOCUMENTS

| | | | |
|---|---|---|---|
| 268,328 | 11/1882 | Webber | 29/262 X |
| 1,276,702 | 8/1918 | Anderson | 254/231 X |
| 1,504,037 | 8/1924 | Furman | 29/261 X |
| 1,798,955 | 3/1931 | Schwerin | 254/231 |
| 2,344,052 | 3/1944 | Neale | 254/231 X |
| 3,076,259 | 2/1963 | Stebbins | 29/259 |
| 4,083,258 | 4/1978 | Hammett | 29/259 X |
| 4,123,838 | 11/1978 | Magavero | 29/261 |

*Primary Examiner*—Stuart S. Levy
*Assistant Examiner*—Katherine Matecki
*Attorney, Agent, or Firm*—Frank D. Gilliam

[57] ABSTRACT

A mechanical puller comprising two "U" shaped frame members one nestable within the other. The two frame members are interconnected through a pivotal bracket carried by the outside frame member. The inner frame member is attached to the outer frame member pivotal bracket by an elongated threaded bolt which passes through an aperture in the pivotal bracket. A nut and washer combination mating with the threaded bolt allows longitudinal adjustment of the inner frame member relative to the pivotal bracket. The inner frame member is both pivotal and rotatable relative to the outer frame member and longitudinally adjustable relative to the pivotal bracket.

8 Claims, 4 Drawing Figures

MECHANICAL PULLER

This application is a continuation of application Ser. No. 622,753, filed June 20, 1984, now abandoned.

BACKGROUND OF THE INVENTION

This invention relates to a puller and particularly to a puller for removing knobs and the like from appliances, and the like, automobile windshields, wiper arms, bathroom shower knobs, faucet knobs and similar applications.

The generally available pullers are directed to the removable gears and the like from central shafts to which they are snuggly attached.

These pullers have outer extending arms with inwardly directed tips which engage the under surfaces of the gears and the like while a central screw length adjustable relative to the tips engage the central shaft to provide opposite relative force between the under surface of the gear or the like and the central shaft. When sufficient force is a applied in this manner the gear or the like is forced from the shaft.

Obviously these pullers cannot be used to remove objects from shafts where the object covers the end of the shaft whereby the shaft end is unaccessible.

There is a continuing need for a puller adaptable for pulling or removing objects forced on a shaft where the shaft end is not accessible for pressure application when removing the object therefrom.

SUMMARY OF THE INVENTION

This invention is directed to a mechanical puller which provides means for grasping the under surface of the object to be pulled from a shaft or the like and applying pressure against the surface adjacent the shaft in which the shaft is supported.

The inner nested frames provide for relative rotational, pivotal and longitudinal movement therebetween. The inner pulling arms are adjustable to fit any size object to be pulled.

An object of the invention is to provide a puller for removing objects from a shaft or the like wherein the shaft or the like is not exposed for applying pressure.

Another object of the invention is to provide a puller which uses the attaching surface to which the shaft or the like is rotatably attached to apply pulling pressure.

Another object of the invention is to provide an expensive puller for removing knobs and the like from central shafts.

Still another object of this invention is to provide a device which includes a minimum of expensive parts and therefore be inexpensively manufactured, easily handled by the most inexperienced technician but of sufficient rigidity and ruggedness to handle the operations for which it is intended.

These and other objects of the invention will become apparent from the following description of the preferred embodiment which is illustrated, by way of example only, in the accompanying drawings, forming part of the specifications in which like reference numerals are used to designate the same or like parts or elements through the same.

DETAILED DESCRIPTION OF THE DRAWINGS

Figure 1:
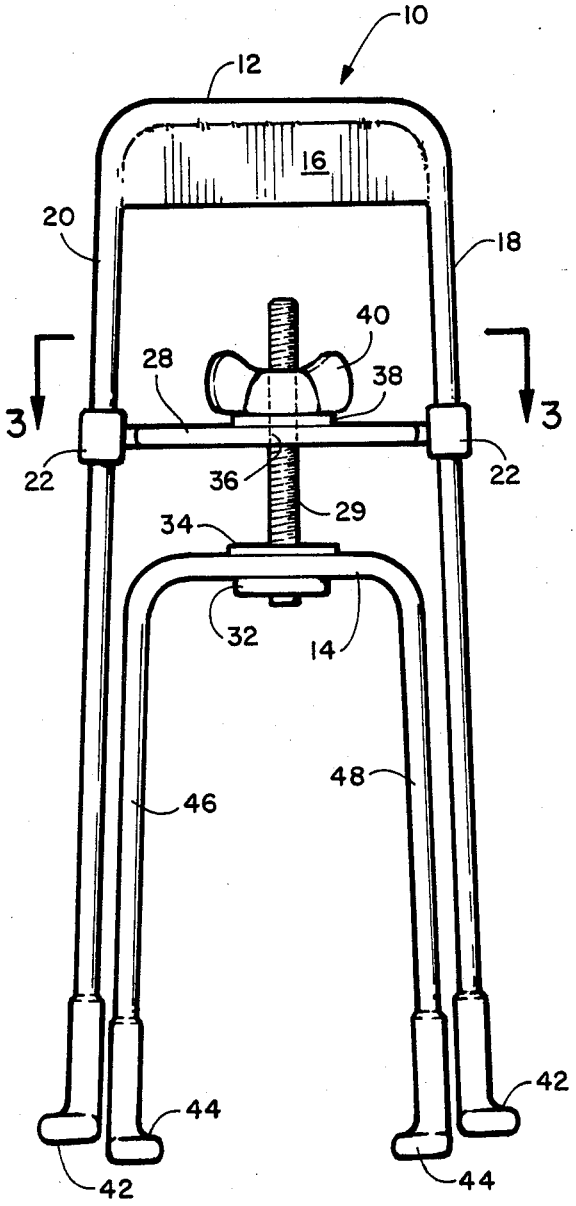
FIG. 1 is a front view of the invention.
Figure 2:
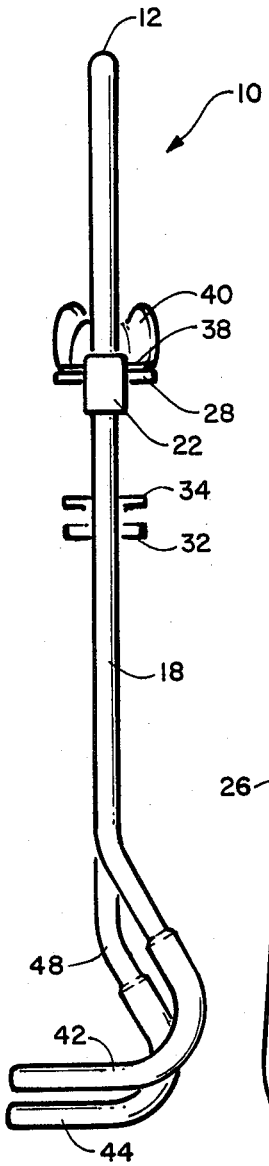
FIG. 2 is a side view thereof.
Figure 3:
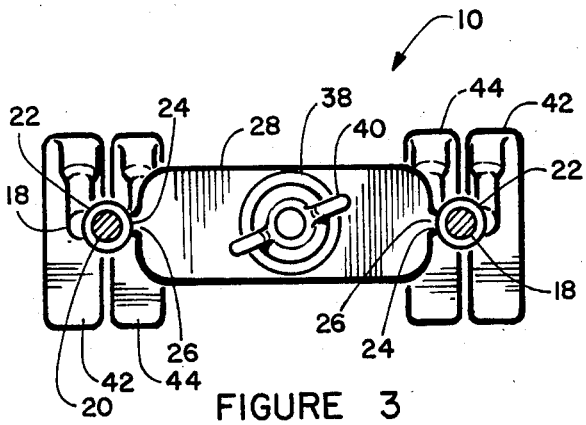
FIG. 3 is a view taken along line 3—3 of FIG. 1.
Figure 4:
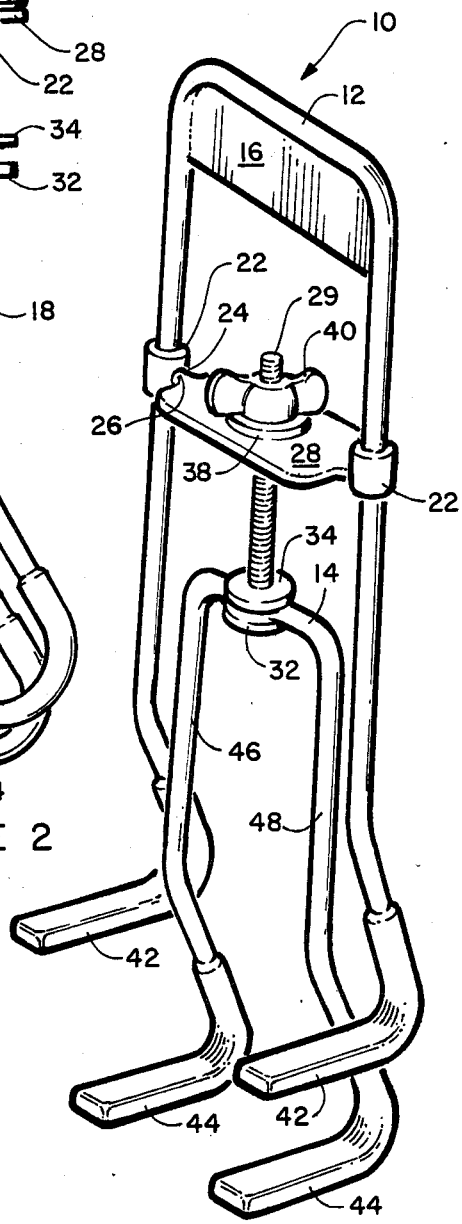
FIG. 4 is a perspective view of the preferred embodiment of the invention.

Referring now to the various drawing Figures, specifically to FIGS. 1 and 4. The puller 10 is formed by a pair of generally "U" shaped frame members 12 and 14. As shown, frame member 12 is larger in dimensions than frame member 14. This allows frame member to fit or rest within frame member 12 as shown. Fixedly secured across the closed end of frame member 12 by means of welding, silver soldering, brazing or the like is a reinforcing member 16. This member 16 provides longitudinal rigidity to legs 18 and 20 of the frame member. Intermediate the closed end of frame 12 and the ends of legs 18 and 20 are positioned a pair of ferrules 22. The ferrules 22 each have an inwardly directed aperture 24. The apertures 24 face each other. Positioned in the apertures 24 are the ends 26 of a bracket 28. The bracket 28 when installed in the apertures is free to pivot or rotate relative to the arms 16 and 18 (see FIG. 3).

Frame member 14 is attached to the bracket 28 by a means of a threaded bolt or the like 29 fixedly attached to frame member 14 centrally at location 30. The bolt or the like 29 is shown attached to frame member 14 by means of a pair of nuts 32 and 34, one positioned on each side thereof tightened one toward the other to lock frame 14 therebetween. The bolt 29 extends through an aperture 36 shown in phantom in FIG. 1. On the opposite side of bracket is a washer or spacer 38 and a wing nut 40. Obviously adjustment of the wing nut 40 along the threads of bolt 29 changes the position of the frame member 14 relative to bracket 28.

On the ends of the frame members 12 and 14 are feet 42 and 44 respectively. These feet are substantially perpendicular with the longest portion of the 18 and 20 of frame member 12 and legs 46 and 48 of frame member 14. The respective legs are first formed backward or away from the distal ends of the feet then in an opposite direction substantially perpendicular with the legs.

The feet and a portion of the legs are shown covered with a resilient material so as to prevent marring or scratching of the knob to be removed or the supporting surface when the puller is used. This resilient material may be rubber, plastic or of any material suitable for the purpose intended.

The use of the puller is self explanitory so only a short explanation of its use follows.

To initiate the pull, the bottom of the feet of both frame members are substantially on the same plane. If the knob has a diameter smaller than the span between the outer feet 42, the feet 44 are inserted between the knob and its supporting surface. The outer feet are then positioned on the surface either adjacent to the feet 44 or in front of or behind the plane of the feet 44. This is accomplished by pivoting the frame member 14 at the bracket 28 or turning the frames relative to each other via the bolt 29 passing through aperture 36 of the bracket 28. When the feet are in place the nut 40 is then threaded on bolt 29 so that the feet 44 are elevated with respect to feet 42 until the knob is pulled free from its engaged shaft.

The legs are formed to pass around and under the knob to be pulled and yet provide a removing force by means of turning of nut 40 which is positioned directly over the hidden shaft center. If the knob to be removed has a diameter greater than the span between feet 44, then feet 42 engage the under surface of the knob to be removed and feet 44 force against the surface to which the shaft is attached.

The puller can be constructed from any material suitable for the purpose intended. A typical material, by way of example and not by way of limitation, would be stainless steel tube formed in the shape shown.

The specific forms of the invention described is a preferred embodiment, it being understood that various changes in construction may be made without departing from the scope of the appended claims.

What is claimed is:

1. A mechanical puller comprising:

a generally "U" shaped cylindrical rigid outer frame member having sides with distal tips, a closed end defined by an end member generally perpendicular to the sides, and an open end adjacent said distal tips;

a generally "U" shaped cylindrical rigid inner frame member having sides with distal tips, a closed end and an open end nestable within said outer frame member;

the sides of both of said cylindrical rigid frame members extending in a first direction between said closed and open ends substantially perpendicular to the end member, and in a second direction at their distal outer tips, said second direction being substantially perpendicular to both said first direction and the end member;

a bracket member which is pivotally mounted on and between said sides of said outer frame member adjacent to the closed end of said outer frame member and spaced between the end member and the distal tips for pivotal rotation relative to said sides of said outer frame member; and an adjustable means interconnecting said inner frame member at its closed end to said pivotal bracket, whereby by adjusting said adjustable means said inner frame member can be vertically relative to said outer frame member whereby the inner frame member can be translated vertically or translated or rotated relative to said outer frame member.

2. The invention as defined in claim 1 wherein a reinforcing member is fixedly attached to the end member along the closed end, and to the adjacent sides of said outer frame member.

3. The invention as defined in claim 1 wherein a portion of the sides and tips are covered with a resilient material.

4. The invention as defined in claim 1 wherein said bracket member includes an aperture therethrough and said adjustable means comprises an elongated thread member fixedly attached to said inner frame member centrally on its closed end for passing freely through said aperture and a washer member positioned adjacent the side of the bracket member remote from said inner frame member, and a nut member adjacent said washer member threadedly engaging said elongated member.

5. The invention as defined in claim 1 wherein said frame members are constructed of metal.

6. The invention as defined in claim 1 wherein said tips on both of said frame members extend in substantially the same direction.

7. The invention as defined in claim 1 wherein said frame members are each formed as a unitary structure.

8. The invention as defined in claim 1 wherein the inner and outer frame members include a curvilinear portion between said first and second directions.

* * * * *